US006446540B1

(12) United States Patent
Ota et al.

(10) Patent No.: US 6,446,540 B1
(45) Date of Patent: Sep. 10, 2002

(54) BEARING FOR SWASH PLATE COMPRESSOR

(75) Inventors: Masaki Ota; Hirotaka Kurakake; Taku Adaniya; Satoshi Inaji, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/568,296

(22) Filed: May 9, 2000

(30) Foreign Application Priority Data

May 11, 1999 (JP) ..... 11-129796

(51) Int. Cl.[7] ..... F01B 3/00
(52) U.S. Cl. ..... 92/71; 91/499
(58) Field of Search ..... 92/71; 91/499; 417/269, 222.2; 74/839

(56) References Cited

U.S. PATENT DOCUMENTS 2,241,046 A * 5/1941 Wahlmark ..... 92/71
4,867,649 A * 9/1989 Kawashima et al. ..... 417/222.2
4,940,393 A * 7/1990 Taguchi ..... 417/222
5,239,913 A * 8/1993 Terauchi ..... 92/71
5,555,626 A 9/1996 Fuchs ..... 30/393
5,582,092 A * 12/1996 Nomura et al. ..... 417/222.2
6,102,670 A * 8/2000 Taguchi ..... 417/222.2

FOREIGN PATENT DOCUMENTS

| | | | |
|---|---|---|---|
| EP | 0 280 479 A2 | 8/1988 | ..... F04B/1/28 |
| EP | 0 853 198 A2 | 7/1998 | ..... F04B/27/08 |
| JP | 3-141877 | 6/1991 | ..... F04B/27/08 |
| JP | 5-195950 | 8/1993 | |
| JP | 10-159723 | 6/1998 | ..... F04B/27/08 |
| JP | 10-196525 | 7/1998 | |

* cited by examiner

*Primary Examiner*—F. Daniel Lopez
*Assistant Examiner*—Igor Kershteyn
(74) *Attorney, Agent, or Firm*—Morgan & Finnegan, LLP

(57) ABSTRACT

A compressor has a housing and a cylinder bore. A piston is accommodated in the cylinder bore. A drive shaft is supported by the housing. An annular support plate is driven by the drive shaft. The support plate surrounds the drive shaft and inclines with respect to the axis of the drive shaft. The support plate has an boss. A radial bearing located about the boss. The radial bearing has an outer race. A disk-like swash plate is formed integrally with the outer race. The swash plate is connected the piston to cause the piston to reciprocate.

3 Claims, 4 Drawing Sheets

BEARING FOR SWASH PLATE COMPRESSOR

BACKGROUND OF THE INVENTION

The present invention relates to a swash plate compressor for air-conditioning vehicles and a radial ball-and-roller bearing for supporting a swash plate.

Japanese Unexamined Patent Publication No. 10-196525 describes a swash plate compressor as shown in FIG. 5. A housing 101 includes a crank chamber 102 and cylinder bores 103. A drive shaft 104 is supported by the housing 101. A support plate 105 is supported by the drive shaft 104 and rotates integrally with the drive shaft 104. A cylindrical boss 107 projects from the center of the support plate 105. A swash plate 106 is supported by the boss 107 through an angular ball bearing 108. The angular ball bearing 108 permits the swash plate 106 to rotate relative to the support plate 105. A piston 109 is accommodaed in each cylinder bore 103. Each piston 109 is coupled to the swash plate 106 through a pair of shoes 110.

Rotation of the drive shaft 104 is converted into reciprocation of the pistons 109 in the cylinder bores 103 through the support plate 105, the angular ball bearing 108, the swash plate 106, and the shoes 110.

In another prior art compressor (not shown), a swash plate is coupled to pistons by rods instead of shoes. This type of compressor includes a mechanism for preventing the rotation of the swash plate such that a strong force is not applied to the couplers between the swash plate and the rods and between the pistons and the rods. In contrast, the compressor of FIG. 5 does not include such mechanism, which simplifies the structure of the compressor. Also, there is no need for forming seats for receiving the rods on the swash plate 106, which simplifies the shape of the swash plate 106.

Friction occurs between the swash plate 106 and the shoes 110. Therefore, the swash plate 106 is hardly rotated by the support plate 105. This prevents friction caused by sliding motion between the shoes 110 and the swash plate 106, which extends life of the parts and prevents power transmission loss.

In the compressor of FIG. 5, an angular ball bearing 108 is located between the boss 107 and the swash plate 106. The bearing 108 includes outer and inner races and balls located between the races. This type of bearing is widely used. However, there is a need to simplify the structure of the bearing 108 to reduce manufacturing costs.

SUMMARY OF THE INVENTION

An objective of the present invention is to provide a swash plate compressor having a simple bearing structure.

To achieve the above objective, the present invention provides a compressor. The compressor has a housing. A cylinder bore is formed in the housing. A piston is accommodated in the cylinder bore. A drive shaft is rotatably supported by the housing. A support plate is integrally driven with the drive shaft. The drive shaft extends through the support plate and inclines with respect to the axis of the drive shaft. The support plate has an axially projecting boss. A radial bearing is located about the boss. The radial bearing has an outer race. A disk-like swash plate is formed integrally with the outer race. The swash plate is connected the piston to cause the piston to reciprocate.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A variable displacement swash plate compressor according to one embodiment of the present invention will now be described with reference to FIGS. 1–4.

Figure 1:
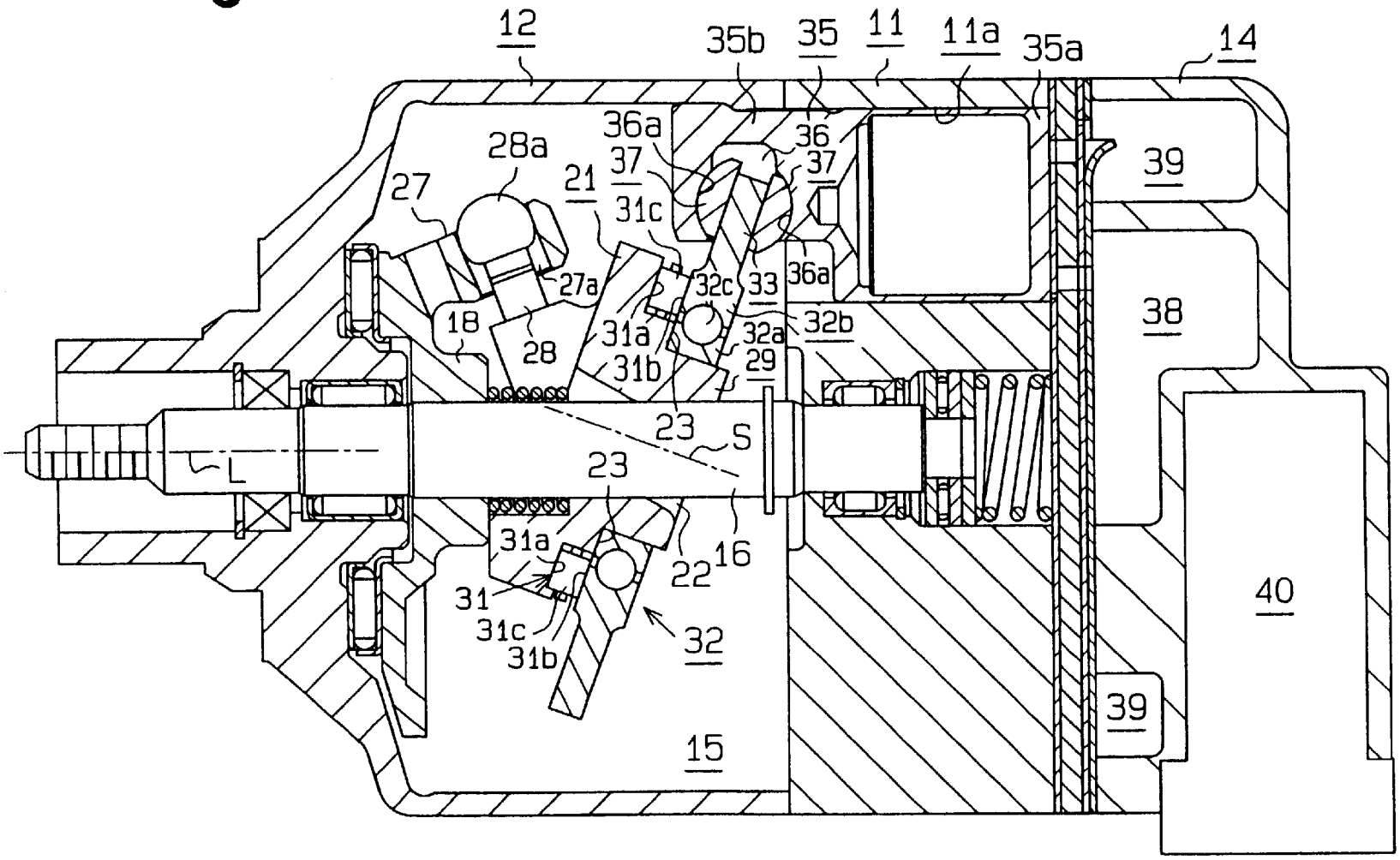
FIG. 1 is a cross-sectional view of a swash plate compressor according to one embodiment of the present invention.

As shown in FIG. 1, the swash plate compressor includes a cylinder block 11, a front housing member 12 coupled to the front of the cylinder block 11, and a rear housing member 14 coupled to the rear of the cylinder block 11. The front housing member 12, the cylinder block 11, and the rear housing member 14 form the compressor housing. A crank chamber 15 is defined between the front housing member 12 and the cylinder block 11.

A drive shaft 16 is supported by the front housing member 12 and the cylinder block 11. The drive shaft is driven by a vehicle engine (not shown). A lug plate 18 is fixed to the drive shaft 16 in the crank chamber 15. A support plate 21 is located in the crank chamber 15. The drive shaft 16 passes through a central hole 22 of the support plate 21.

A pair of support arms 27 are formed on the rear surface of the lug plate 18. A guide hole 27*a* is formed in the distal end of each support arm 27. Two guide pins 28, which are formed on the front surface of the support plate 21, include spherical portions 28*a* at their distal ends, respectively. The spherical portions 28*a* of the guide pins 28 are received in the corresponding guide holes 27*a* of the support arms 27.

The support plate 21 integrally rotates with the drive shaft 16 through the guide pins 28 and the support arms 27. The support plate 21 is supported by the drive shaft 16 and slides axially and inclines with respect to the axis L of the drive shaft 16.

Figure 2:
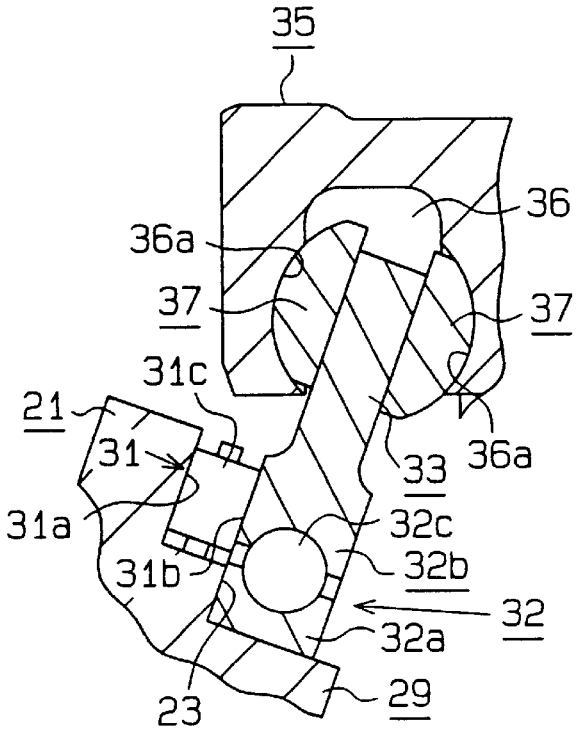
FIG. 2 is a partial enlarged view showing a part of the compressor of FIG. 1.

A boss 29 is formed on the rear surface of the support plate 21 about the axis S of the support plate 21. An annular positioning surface 23 is formed on the support plate 21 as shown in FIGS. 1 and 2. The diameter of the positioning surface 23 is greater than that of the boss 29.

Figure 3:
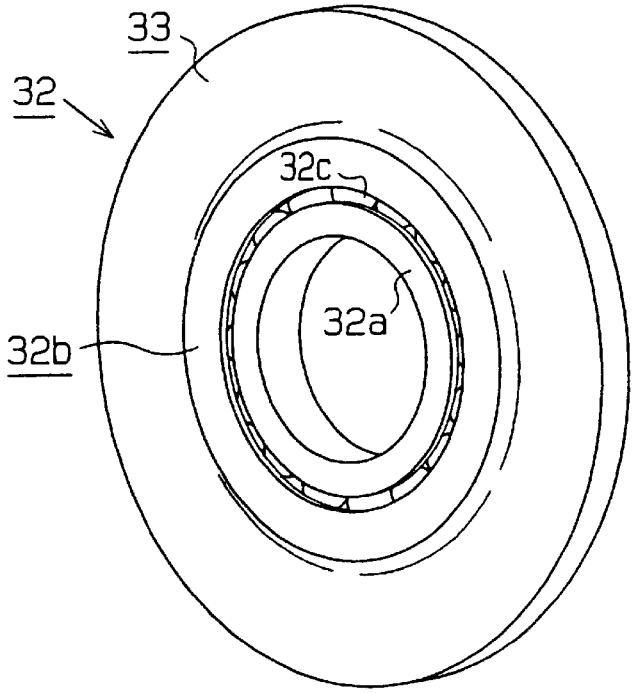
FIG. 3 is a perspective view of an angular bearing.

As shown in FIGS. 1–3, an angular ball bearing 32, which serves as a radial bearing, is located between the boss 29 and a swash plate 33. The ball bearing 32 includes an inner race 32*a*, an outer race 32*b*, and balls 32*c*. The inner race 32*a* is press-fitted to the boss 29. The balls 32*c* are located between the inner race 32*a* and the outer race 32*b*. The position of the inner race 32*a* is determined by the positioning surface 23 the rear surface of which contacts the inner race 32*a*. The flange-shaped swash plate 33 is located on the radially outer side of the outer race 32*b*.

As shown in FIGS. 1 and 2, a thrust roller bearing 31 is located between the outer race 32*b* of the angular ball bearing 32 and the support plate 21. The thrust roller bearing 31 includes rollers 31*c*. The rollers 31*c* are located between a front contact surface 31*a* on the support plate 21, and a contact surface 31*b* on the outer race 32*b* of the angular ball bearing 32.

The front contact surface 31*a* is located on an annular rear surface of the support plate 21 and is radially outward of the positioning surface 23. The rear contact surface 31*b* is located on an annular front surface of the outer race 32*b*. The rollers 31*c* roll directly on the support plate 21 and the outer race 32*b*.

Cylinder bores 11*a* are formed in the cylinder block 11. A suction chamber 38 and a discharge chamber 39 are formed in the rear housing member 14. Each single-headed piston 35 is accommodated reciprocally in each bore 11*a*, and each piston 35 has a head 35*a* and a neck 35*b*. The head 35*a* of each piston 35 is located in the corresponding cylinder bore 11*a*. A recess 36 is formed in each neck 35*b*. Semi-spherical shoe seats 36*a* are formed in opposite surfaces of each recess 36.

A pair of semi-spherical shoes 37 are received by the shoe seats 36*a* in each recess 36 such that each shoe 37 can slide with respect to the corresponding seat 36*a*. The periphery of the swash plate 33 is received between the shoes 37 in each recess 36. The surfaces of the swash plate 33 that contact the shoes 37 are plated with tin or coated with molybdenum disulfide to reduce friction.

When an external drive source rotates the drive shaft 16, the support plate 21 is rotated by the lug plate 18. The axis S of the support plate 21 is inclined with respect to the axis L of the drive shaft 16. Accordingly, a point on the support plate 21 moves rearward and frontward with respect to the cylinder block 11 when the support plate 21 rotates, and this motion is converted into reciprocation of the pistons 35 through the swash plate 33 and the shoes 37. The reciprocation of the pistons 35 repeats a cycle of drawing refrigerant gas into the cylinder bores 11*a*, compressing the refrigerant gas, and discharging the refrigerant gas to the discharge chamber 39.

The support plate 21 rotates relative to the swash plate 33 (or the outer race 32*b*), and the friction between the swash plate 33 and the shoes 37 prevents the swash plate 33 from being rotated by the support plate 21.

The inclination angle of the axis S of the support plate 21 with respect to the axis L of the drive shaft 16 is varied by varying the pressure in the crank chamber 15 with a control valve 40. This varies the stroke of the pistons 35 and adjusts the compressor displacement.

When the pressure in the crank chamber 15 is increased, the center of the support plate 21 moves rearward (rightward in FIG. 1), which reduces the inclination of the support plate 21 and the compressor displacement. When the pressure in the crank chamber 15 is reduced, the center of the support plate 21 moves frontward, which increases the inclination of the support plate 21 and the compressor displacement.

As mentioned in the Background section, there is another type of compressor that has a swash plate coupled to pistons by rods instead of shoes. In this type of compressor, a mechanism for preventing the rotation of the swash plate is provided to prevent a strong force from being applied to couplers between the rods and the swash plate and between the pistons and the rods. In contrast, the compressor of FIG. 1 has no such mechanism, which simplifies the structure of the compressor. Also, there is no need to form seats for receiving rods on the swash plate 33, which simplifies the shape of the swash plate 33.

Friction occurs between the swash plate 33 and the shoes 37. This substantially prevents the swash plate 33 from being rotated by the support plate 21. However, even if the swash plate 33 is rotated by the support plate 21, the relative rotation speed between the swash plate 33 and the shoes 37 is slow, which limits power losses and extends the life of the compressor, compared with a compressor in which swash plate and shoes in high speed.

The characteristics of the present embodiment will now be described.

As shown in FIGS. 1–3, the swash plate 33 is integrally formed with the outer race 32*b* and coupled to the pistons 35 through the shoes 37, which simplifies the shape of the swash plate 33. The swash plate is flat and annular.

Since the swash plate has a simple shape, the outer race 32*b* of the angular ball bearing 32 is integrally formed with the swash plate without difficulty. That is, the outer race 32*b* and the swash plate 33 are formed by cutting a flat annular metal plate.

Figure 4:
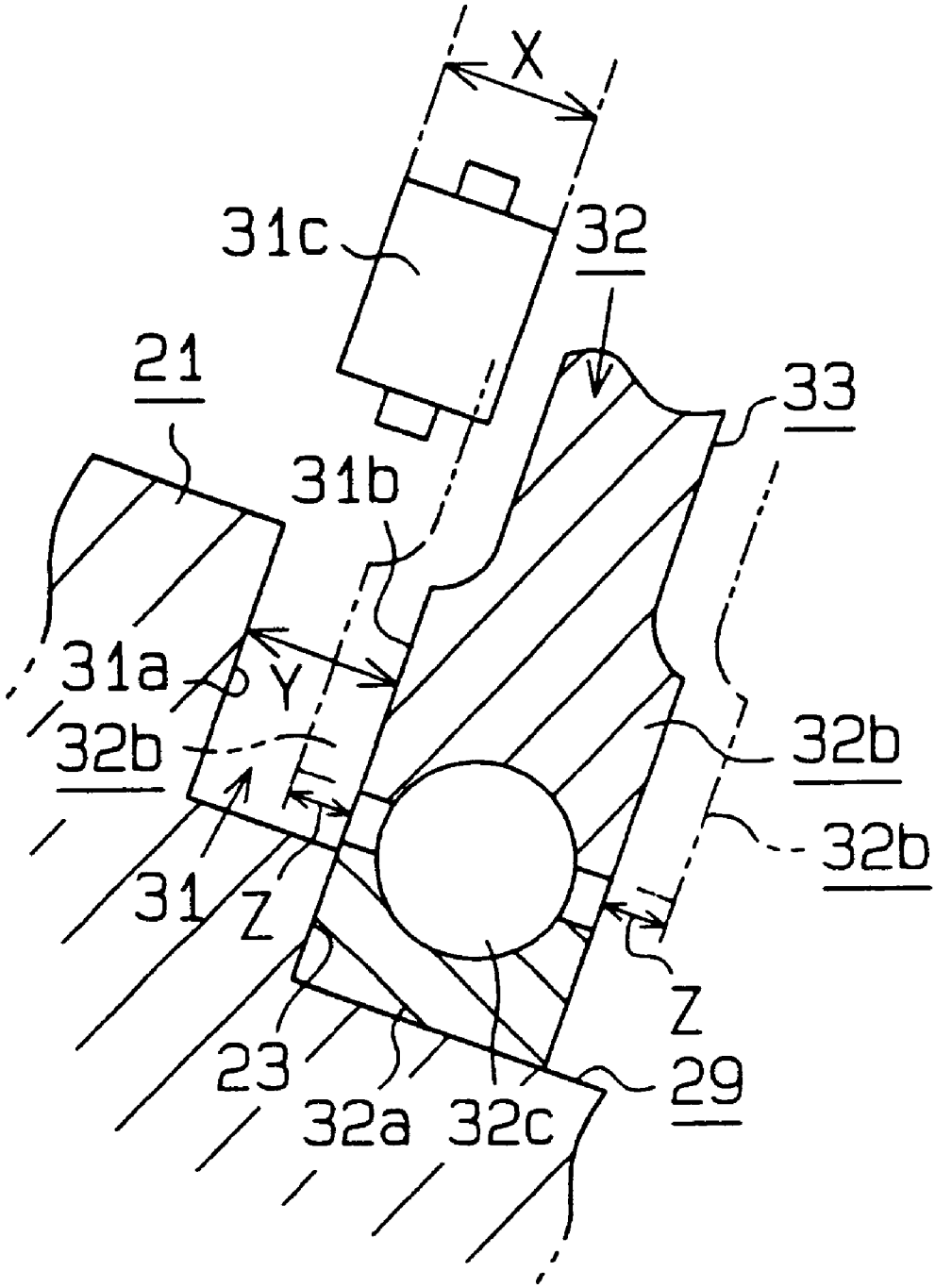
FIG. 4 is a partial enlarged cross-sectional view similar to FIG. 2.
Figure 5:
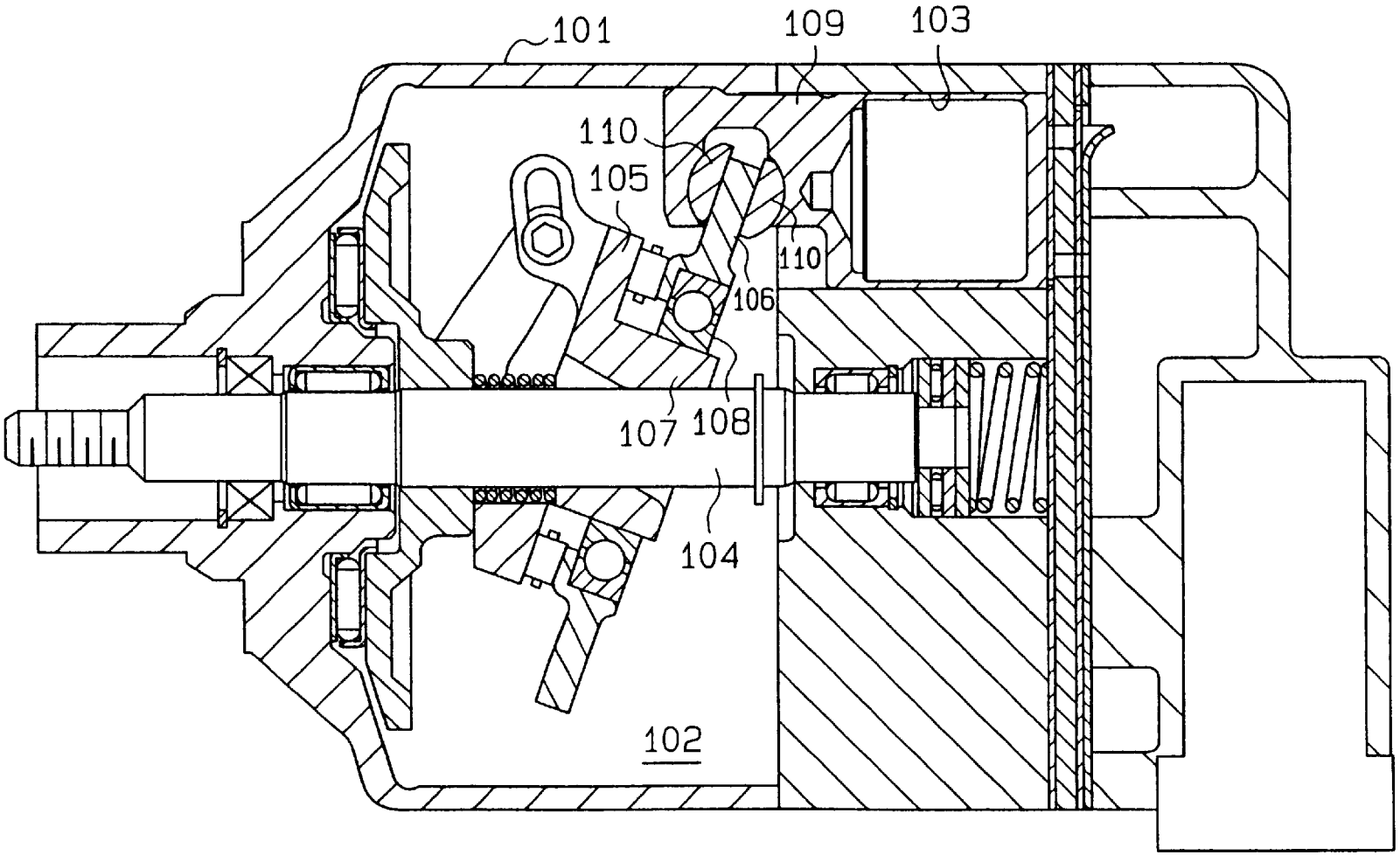
Fig.5 (Prior Art)
FIG. 5 is a cross-sectional view of a prior art swash plate compressor.

As shown in FIG. 4, the dimensions of the couplers between the support plate 21 and the pistons 35 are determined to meet the following expression (1).

$$Z>|X-Y| \quad (1)$$

X represents the diameter of the rollers 31 of the thrust bearing 31.

Y represents the distance between the rolling surfaces 31*a*, 31*b* before the rollers 31*c* are assembled in a state that the inner race 32*a* contacts the positioning surface 23 assumed there are no clearances in the radial bearing 32 in the thrust direction (shown by the solid line of FIG. 4).

Z represents the maximum offset amount of the outer race 32*b* from the inner race 32*a* (shown by the broken lines of FIG. 4 in an exaggerated manner).

In the present embodiment, the expression (1) is satisfied when X is greater than Y. That is, if X is greater than Y when the rollers 31*c* are located between the contact surfaces 31*a* and 31*b*, the distance between the contact surfaces 31*a* and 31*b* is extended to X. Therefore, the outer race 32*b* moves rearward along the axis S relative to the inner race 32*a* by a distance represented by X minus Y.

When the expression (1) is satisfied, the increase of Y by X minus Y is permitted by offsetting the outer race 32*b* from the inner race 32*a*. The offset movement prevents the rollers 31*c* from continuously being pressed too forcefully between the contact surfaces 31*a*, 31*b*, which prevents the thrust roller bearing 31 from receiving an excessive load.

The expression (1) can be satisfied when X is less than Y. If the rollers 31*c* are located between the contact surfaces 31*a*, 31*b* when X is less than Y, there is some clearance between the rollers 31*c* and the contact surfaces 31*a*, 31*b*. However, when the compressor is operating, a compression load is applied to the swash plate 33 through the pistons 35, which moves the outer race 32*b* toward the contact surface 31*a* on the support plate 21. Therefore, the rollers 31*c* are firmly received between the contact surfaces 31*a*, 31*b*.

When the expression (1) is satisfied, the outer race 32*b* is permitted to move toward the support plate 21 by a distance represented by Y minus X. Accordingly, the rollers 31*c* are firmly received between the contact surfaces 31*a*, 31*b*, and the thrust roller bearing 31 receives the compression load applied to the swash plate 33.

The present embodiment has the following advantages.

The swash plate 33 is integrally formed with the outer race 32*b* of the angular ball bearing 32. The contact surfaces

31*a*, 31*b*, which serve as races for the thrust roller bearing 31, are directly formed on the support plate 21 and the outer race 32*b* of the thrust roller bearing 31, respectively. This reduces the number of parts and manufacturing costs.

The present invention can further be embodied as follows.

A radial roller bearing may be used instead of the angular ball bearing 32.

The present invention may be embodied to the other types of swash plate compressors, such as, fixed displacement type, double head piston type.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A compressor comprising:

a housing;

a cylinder bore formed in the housing;

a piston accommodated in the cylinder bore;

a drive shaft rotatably supported by the housing;

a support plate integrally driven with the drive shaft, wherein the drive shaft extends through the support plate, wherein the support plate inclines with respect to the axis of the drive shaft, wherein the support plate has an axially projecting boss;

a radial bearing located about the boss, wherein the radial bearing has an outer race;

a thrust bearing located between the outer race of the radial bearing and the support plate, wherein the thrust bearing is a thrust roller bearing, wherein the thrust roller bearing has rollers and the outer race of the radial bearing has a contact surface on which the rollers of the thrust bearing roll; and a disk-like swash plate formed integrally with the outer race, wherein the swash plate is connected to the piston to cause the piston to reciprocate.

2. The compressor according to claim 1, wherein the radial bearing has an inner race fitted to the boss, wherein the support plate has a positioning surface to contact the inner race such that the positioning surface limits axial movement of the inner race in one direction, and the contact surface functions as a rear contact surface, and a front contact surface is formed on the support plate to face the rear contact surface, wherein the rollers of the thrust roller bearing are located between the front contact surface and the rear contact surface, wherein when X represents the diameter of the roller of the thrust bearing, and Y represents the distance between the front and the rear contact surfaces before the roller is assembled with the inner race contacting the positioning surface, assuming there is no slack in the radial bearing in the thrust direction, and Z represents a maximum allowance offset amount, in the axial direction, of the outer race from the inner race, the following equation is satisfied:

$$Z>|X-Y|.$$

3. A compressor comprising a housing a cylinder bore formed in the housing;

a piston accommodated in the cylinder bore;

a drive shaft rotatably supported by the housing;

an annular support plate intergrally driven with the drive shaft, wherein the drive shaft extends through the support plate, wherein the support plate inclines with respect to the axis of the drive shaft, wherein the support plate has an axially projecting boss;

a radial bearing located about the boss, wherein the radial bearing has an inner race fixed to the boss, and outer race, and balls located between the inner race and the outer race;

a thrust roller bearing located between the support plate and the outer race of the radial bearing, wherein the thrust roller bearing has rollers, wherein the outer race of the radial bearing has a contact surface on which the rollers of the thrust roller bearing roll; and a disk-like swash plate formed integrally with the outer race of the radial bearing, wherein the swash plate is connected to the piston to cause the piston to reciprocate.

* * * * *

UNITED STATES PATENT AND TRADEMARK OFFICE

CERTIFICATE OF CORRECTION

PATENT NO. : 6,446,540 B1 
DATED : September 10, 2002
INVENTOR(S) : Ota et al.

It is certified that error appears in the above-identified patent and that said Letters Patent is hereby corrected as shown below:

Column 6,
Line 30, please delete “boss, and outer” and insert therefor -- boss, an outer --.

Signed and Sealed this

Twenty-fifth Day of February, 2003

JAMES E. ROGAN
*Director of the United States Patent and Trademark Office*